US006874646B2

(12) United States Patent
Jay

(10) Patent No.: US 6,874,646 B2
(45) Date of Patent: Apr. 5, 2005

(54) DEPTH-EXTENDABLE DISPLAY TRACK UNIT

(75) Inventor: Richard Jay, Westport, CT (US)

(73) Assignee: Display Technologies, LLC, College Point, NY (US)

( * ) Notice: Subject to any disclaimer, the term of this patent is extended or adjusted under 35 U.S.C. 154(b) by 10 days.

(21) Appl. No.: 10/043,844

(22) Filed: Jan. 14, 2002

(65) Prior Publication Data

US 2003/0132182 A1 Jul. 17, 2003

(51) Int. Cl.[7] ..... A47F 1/04
(52) U.S. Cl. ..... 211/59.2; 211/175
(58) Field of Search ..... 211/175, 59.2, 211/59.3; 108/64, 65, 57.26, 53.1, 53.3, 91

(56) References Cited

U.S. PATENT DOCUMENTS

| | | | | | |
|---|---|---|---|---|---|
| 1,879,372 | A | | 9/1932 | Comb | |
| 1,934,389 | A | * | 11/1933 | Ulsh | 108/52.3 |
| 3,000,515 | A | | 9/1961 | Gifford | |
| 4,364,481 | A | | 12/1982 | Ricci | |
| 4,460,096 | A | | 7/1984 | Ricci | |
| 4,478,337 | A | | 10/1984 | Flum | |
| 4,801,025 | A | | 1/1989 | Flum et al. | |
| 4,958,739 | A | | 9/1990 | Spamer | |
| 4,997,094 | A | * | 3/1991 | Spamer et al. | 211/153 |
| 5,024,336 | A | | 6/1991 | Spamer | |
| 5,050,748 | A | | 9/1991 | Taub | |
| 5,182,996 | A | * | 2/1993 | Gutgsell | 108/64 |
| 5,183,163 | A | * | 2/1993 | Slaiken | 211/43 |
| 5,240,126 | A | | 8/1993 | Foster et al. | |
| 5,242,223 | A | | 9/1993 | Koves | |
| 5,243,794 | A | * | 9/1993 | Pikor | 52/136 |
| 5,265,738 | A | | 11/1993 | Yablans et al. | |
| 5,457,859 | A | | 10/1995 | Kacprowicz et al. | |
| 5,458,248 | A | | 10/1995 | Alain | |
| 5,562,217 | A | | 10/1996 | Salveson et al. | |
| 5,624,042 | A | | 4/1997 | Flum et al. | |
| 5,634,564 | A | | 6/1997 | Spamer et al. | |
| 5,645,176 | A | | 7/1997 | Jay | |
| 5,661,859 | A | * | 9/1997 | Schaefer | 5/621 |
| 5,685,664 | A | | 11/1997 | Parham et al. | |
| 5,695,077 | A | | 12/1997 | Jay | |
| 5,884,782 | A | | 3/1999 | Dembicks | |
| 6,032,590 | A | * | 3/2000 | Chen | 108/158.12 |
| 6,085,668 | A | * | 7/2000 | Kanki | 108/65 |
| 6,142,316 | A | | 11/2000 | Harbour et al. | |
| 6,325,221 | B2 | * | 12/2001 | Parham | 211/59.2 |
| 6,523,702 | B1 | * | 2/2003 | Primiano et al. | 211/59.2 |
| 6,615,995 | B2 | | 9/2003 | Primiano et al. | |

* cited by examiner

*Primary Examiner*—Blair M. Johnson
(74) *Attorney, Agent, or Firm*—Amster, Rothstein & Ebenstein

(57) ABSTRACT

A depth-extendable display unit consists of at least two essentially identical standard depth display tracks for forming a single depth-extended display track from one of the tracks and at least one section of another of the tracks. Each track has a front section, a breakaway back section with a rear connector at the rear thereof, and an interconnected series of breakaway intermediate sections connecting the front and back sections. The intermediate and back sections define at the front thereof forward connectors for engagement with the rear connectors, the forward connectors being exposed for engagement by breaking away of the immediately forward section.

16 Claims, 8 Drawing Sheets

FIG. 11
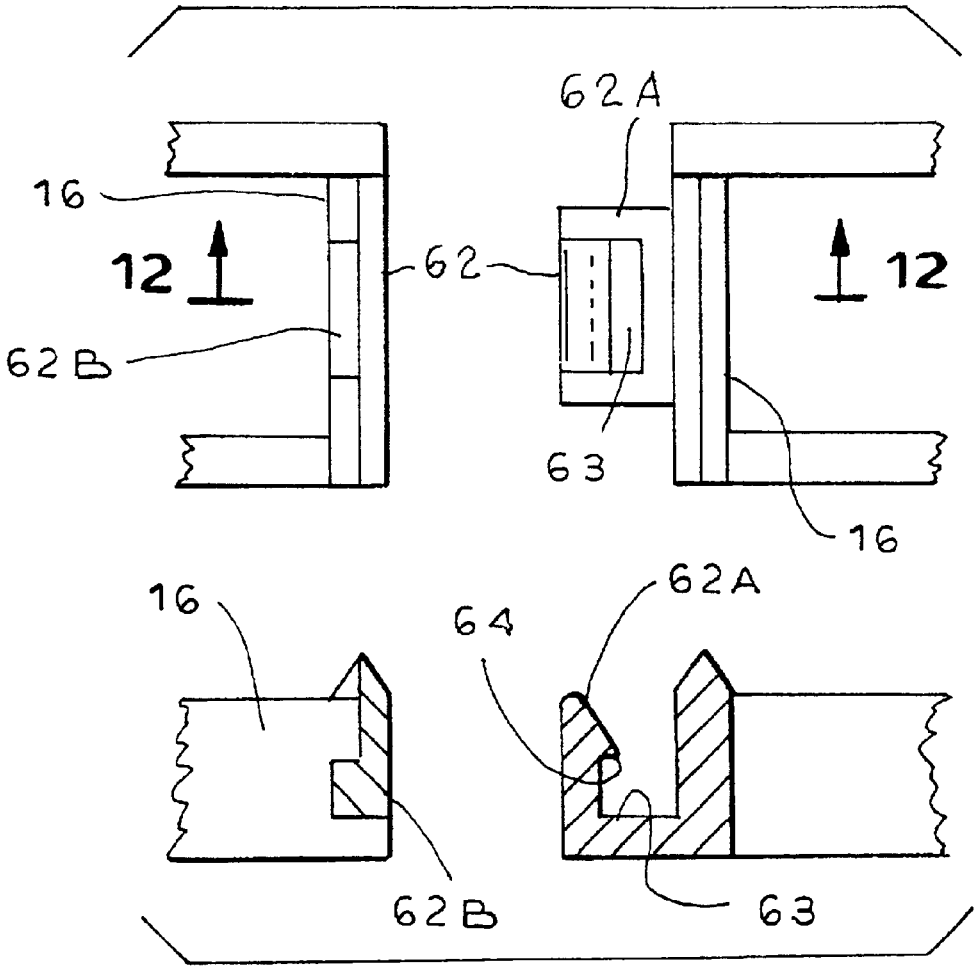
FIG. 12
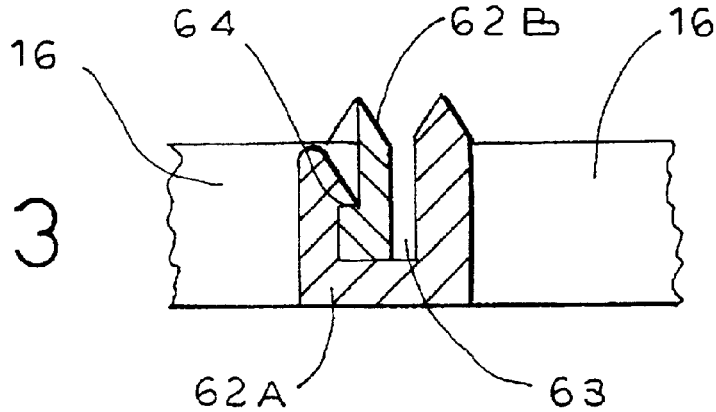
FIG. 13

DEPTH-EXTENDABLE DISPLAY TRACK UNIT

BACKGROUND OF THE INVENTION

The present invention relates to a display track, and more particularly to a depth-extendable display track unit.

Display shelves are commonly found in stores, supermarkets, and the like for the display of products available for sale. The display shelf may be flat, in which case there is typically a spring-loaded pusher unit to push the displayed products forward as each foremost product is purchased and removed, or inclined, in which case, as each foremost product is removed, the remainder of the products move forwardly under the influence of gravity (such shelves typically being known as "gravity-feed shelves"). Depending upon the type of products to be displayed, the display shelf may be disposed on a counter or table top (for example, where the products for display are batteries, film, or other products commonly sold at room temperature) or on a supporting tray in a refrigeration unit (for example, where the products are bottles or cans of beer, soda, milk or other products commonly sold chilled). The display shelf may consist of a single track or channel but more commonly consists of a plurality of such tracks disposed side-by-side in either a fixed or releasable relationship.

From the point of view of the retailer, the display shelf should be of sufficient depth (that is, the length from the front thereof to the back thereof) that the entire depth of the support surface (i.e., the counter, table top or refrigeration tray) is occupied by the shelf—that is, so that there is no wasted space. If the display shelf does not occupy the full depth, objects placed on the support surface in front of the display shelf will conceal the products intended to be displayed on the display shelf, while objects placed on the support surface behind the display shelf will be at least partially hidden from customer view and not readily accessible to a potential customer. This problem has been addressed in the past by providing a "standard depth" shelf which has breakaway rear portions enabling the depth of the display shelf to be shortened to meet the available space. An obvious disadvantage of this solution to the problem is that some counters, tabletops or refrigeration trays will be deeper than the "standard depth" display shelves.

Another solution to this problem is to provide the retailer with a "standard depth" display shelf and add-on sections. The add-on sections may be "added on" to the back of the display shelf (assuming that the display shelf does not have a back wall which would interfere with the passage of products from the add-on sections to the main display shelf). Alternatively, where the front and back sections of the display shelf may be separated (e.g., broken-away), the add-on sections may be inserted between the separated front and back sections of the display shelf.

The "add-on sections" solution is not favored, however, either by the retailer or the display shelf manufacturer. Typically additional members—e.g., fasteners or connecters—must be used to connect the add-on sections either to the back section of the display shelf or to the front of the back section and the back of the front section of the display shelf. Such connecters are typically relatively small and easy to lose during the assembly process. From the point of view of the manufacturer of the display shelf, the add-on sections solution is particularly onerous because the manufacturer must not only purchase, maintain and operate the usual molds for the production of the standard depth display shelf, but also a special mold for the production of the add-on sections. The add-on sections solution further entails logistical problems in that a separate inventory of the add-on sections must be maintained by the manufacturer, made available for purchase, and delivered to purchasers. In brief, the manufacturer must manufacture, sell and deliver two products—that is, the standard depth display shelf and the add-on sections—rather than merely one product (that is, the standard depth display shelf).

As a practical matter, the dilemma of the producer is even greater since the customer may desire add-on sections of different depths so that the customer can make full use of the available depths of a variety of different-depth support surfaces. Each of these add-on sections of differing depth then becomes yet another product line to be manufactured, sold and delivered by the manufacturer.

Accordingly, it is an object of the present invention to provide a depth-extendable display track unit enabling a customer to form a depth-extended display track.

Another object is to provide such a unit which in one preferred embodiment consists of at least two essentially identical standard depth display tracks.

A further object is to provide such a unit which in one preferred embodiment does not require the manufacturer to manufacture, sell or deliver add-on sections to enable formation of the depth-extended display track.

It is also an object of the present invention to provide such a unit wherein in one preferred embodiment depth extension is achievable without the use of additional components such as fasteners.

It is a further object to provide such a unit which is simple and inexpensive to manufacture and use.

SUMMARY OF THE INVENTION

It has now been found that the above and related objects of the present invention are obtained in a depth-extendable display track unit. The depth-extendable display track unit consists of at least two essentially identical standard depth display tracks for forming a single depth-extended display track from one of the standard depth display tracks and at least one section of another of the standard depth display tracks. Each of the essentially identical standard depth display tracks comprises a front section, a breakaway back section with rear engagement means at the rear thereof, and an interconnected series of breakaway intermediate sections connecting the front and back sections. The intermediate and back sections define at the front of each such section forward engagement means for engagement with the rear engagement means at the rear of the back section, the forward engagement means being exposed for engagement by breaking away of the immediately forward section.

In a preferred embodiment, in each of the essentially identical standard depth display tracks, the rear engagement means projects rearwardly from the back section, and the forward engagement means is configured and dimensioned to receive therein the rear engagement means. Preferably the forward engagement means is female in nature, the rear engagement means is male in nature, and the forward and rear engagement means cooperatively form a female/male engagement. Preferably the forward and rear engagement means are disposed below the level of an article-supporting surface of the intermediate and back sections.

Optionally the front section defines at the front thereof stop means for limiting forward movement of articles on the standard depth display track.

In each of the essentially identical standard depth display tracks, at least one of the intermediate sections preferably differs in depth from at least one other of the intermediate sections.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIGS. 11, 12 and 13 are fragmentary views, to a further enlarged scale, of the bracketed segment of FIG. 6 showing the lateral connecting means, FIGS. 11 and 12 being fragmentary top plan and sectional side elevational views, respectively, of the lateral connecting means prior to connection and FIG. 13 being a fragmentary sectional side elevational view showing the lateral connection means after connection.

DETAILED DESCRIPTION OF THE PREFERRED EMBODIMENTS

While the present invention will be illustrated and described herein in the context of a display shelf consisting of a single display track, it will be apparent to those skilled in the art that the same principles may be applied to any display shelf, whether it contains only one or a plurality of display tracks.

Figure 1:
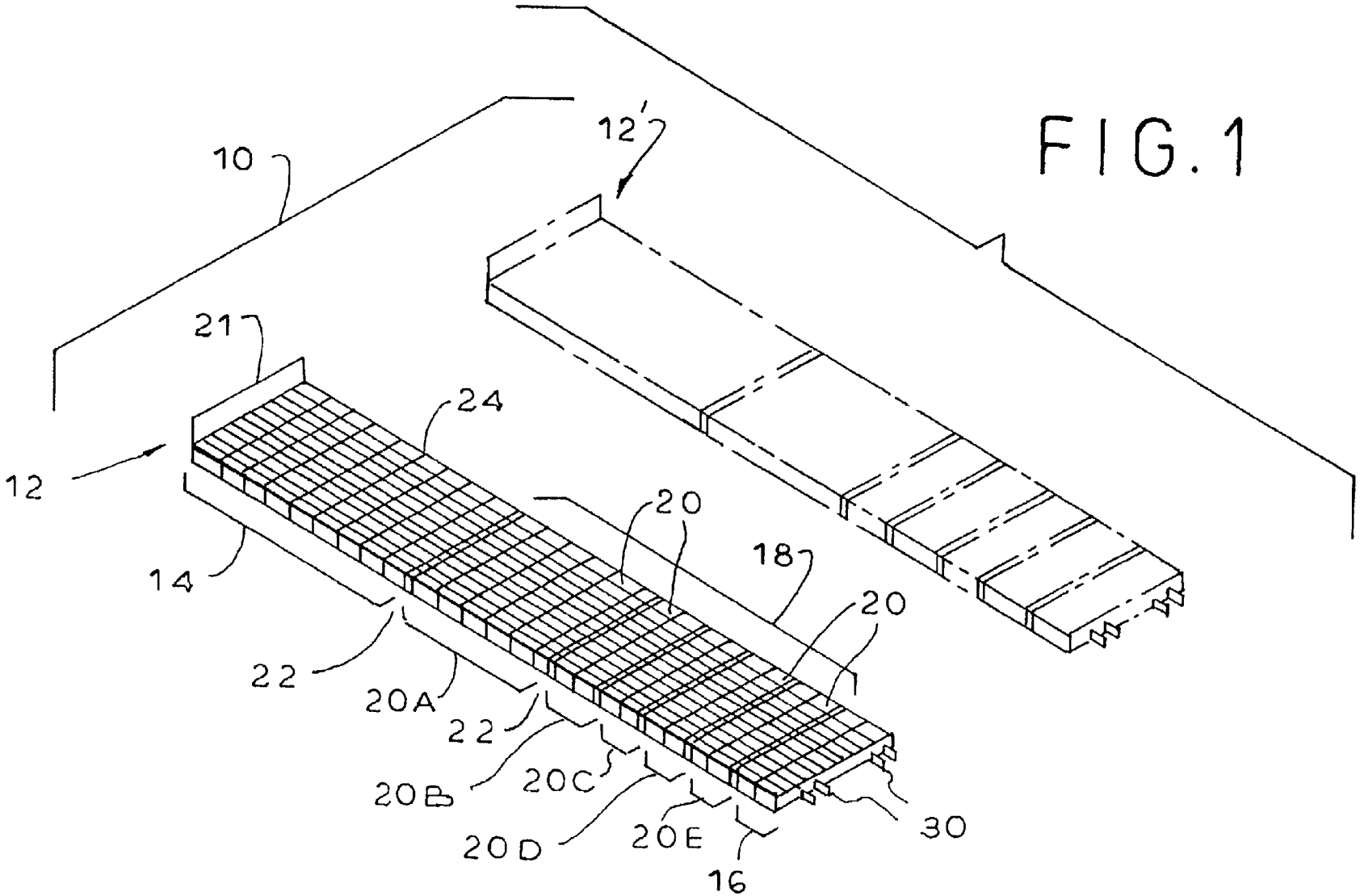
FIG. 1 is an isometric schematic view of a depth-extendable display track unit according to the present invention, including two standard depth display tracks.
Figure 2:
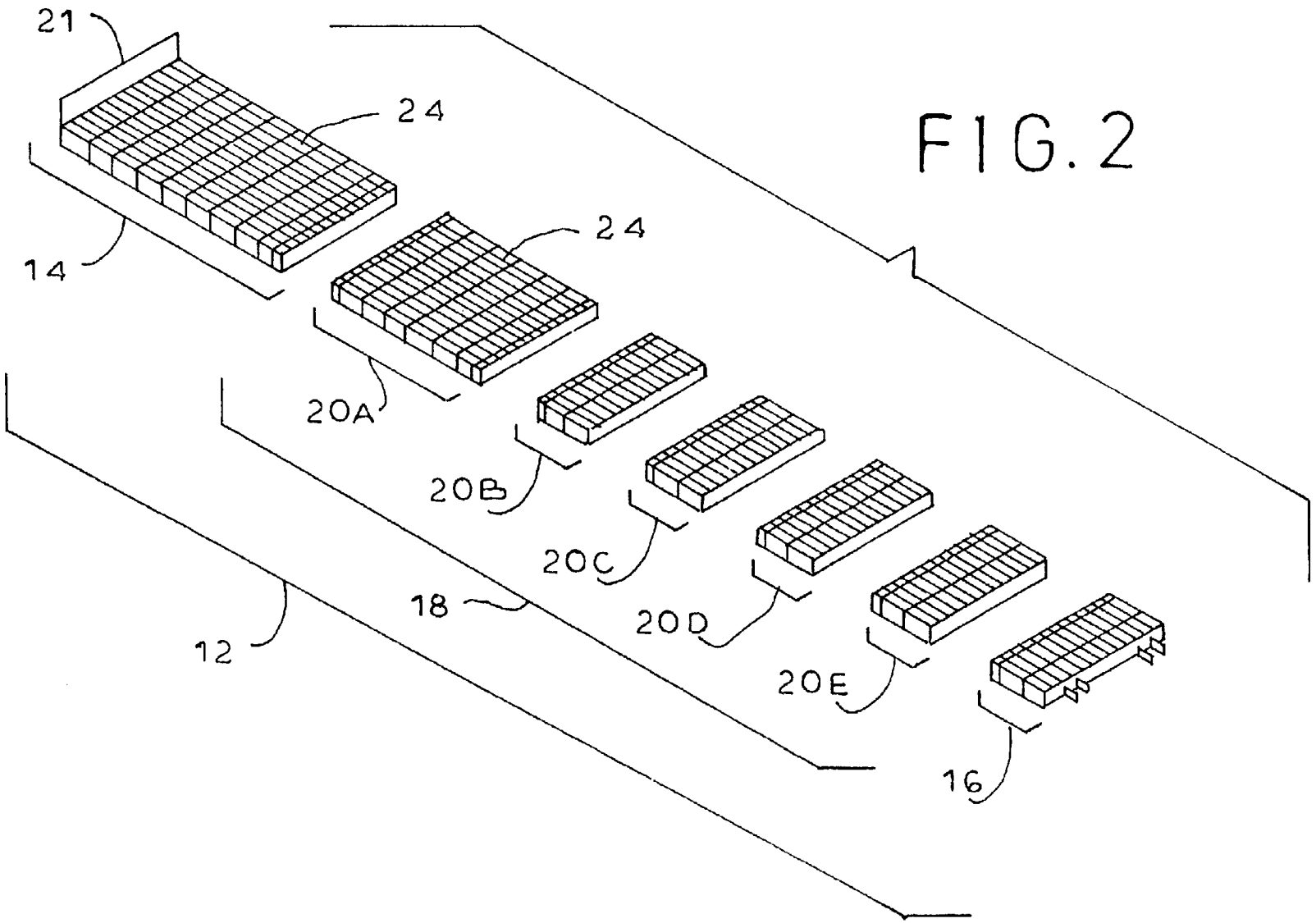
FIG. 2 is an exploded isometric view of one of the two standard depth display tracks of the unit.

Referring now to the drawing, and in particular FIG. 1 thereof, therein illustrated is a depth-extendable display track unit according to the present invention, generally designated by the reference numeral 10. The unit 10 consists of at least two essentially identical standard depth display tracks, generally designated 12, 12'. The display tracks 12, 12' are essentially identical in that they are formed in essentially identical molds and preferably have essentially identical surface ornamentation applied thereto. The display tracks may be purchased as a kit consisting of at least two such tracks 12, 12' to form the unit 10, or each track 12, 12' may be purchased separately and independently of one another but then cooperatively used as indicated herein below, just as if they had been purchased as a unit 10. Of course, each display track 12, 12' may be used separately and independently from the others as a standard depth display track.

As the tracks 12, 12' are identical, the detailed description of track 12 hereinbelow will also serve as a detail explanation of the track 12'. Similar elements of the tracks 12, 12' will be identified by the same reference numeral, but with the elements of track 12' being primed.

Referring now in particular to FIGS. 2 and 4–6, each of the essentially identical standard depth display tracks 12 comprises a front section 14, a back section 16 and an interconnected series 18 of intermediate sections 20, the interconnected series 18 serving to connect the front and back sections 14, 16. As illustrated, the interconnected series 18 contains some five intermediate sections 20 identified as 20A through 20E.

The front section 14 is of conventional design and, especially in a gravity-feed display, will include stop means for limiting forward movement of articles on the track 12, typically an upstanding lip 21 restraining the forward movement of the lead article in a series of articles. The back section 16 has a conventional breakaway feature which enables the retailer to separate the back section 16 from the immediately forward section which, in the present instance, would be the last intermediate section 20E of the interconnected series 18. The breakaway feature is typically implemented by providing a plane of weakness 22 extending through the track 12 transverse to the major longitudinal dimension of the track. Thus a horizontal line of weakness 22 extends not only across the floor 24 of the track which supports the articles to be displayed, but also through the entire height of any sidewalls 26 on either side of the floor 24. Thus the plane of weakness 22 extending through the floor 24 and sidewalls 26 enables the back section 16 to be easily and conveniently intentionally removed from the remainder of the track 12. This breakaway back feature is conventional in nature and hence need not be described herein in further detail. The breakaway feature is conventionally used to enable the conventional standard depth display track to be used in situations where there is only limited depth available.

The interconnected series 18 of intermediate sections 20 connecting the front and back sections 14, 16 is also characterized by a breakaway feature allowing each intermediate section 20 to be broken-away, either individually and successively or as one or more groups of intermediate sections 20, where a further depth reduction is required above and beyond that provided by removal of the back section 16 alone.

Figure 4:
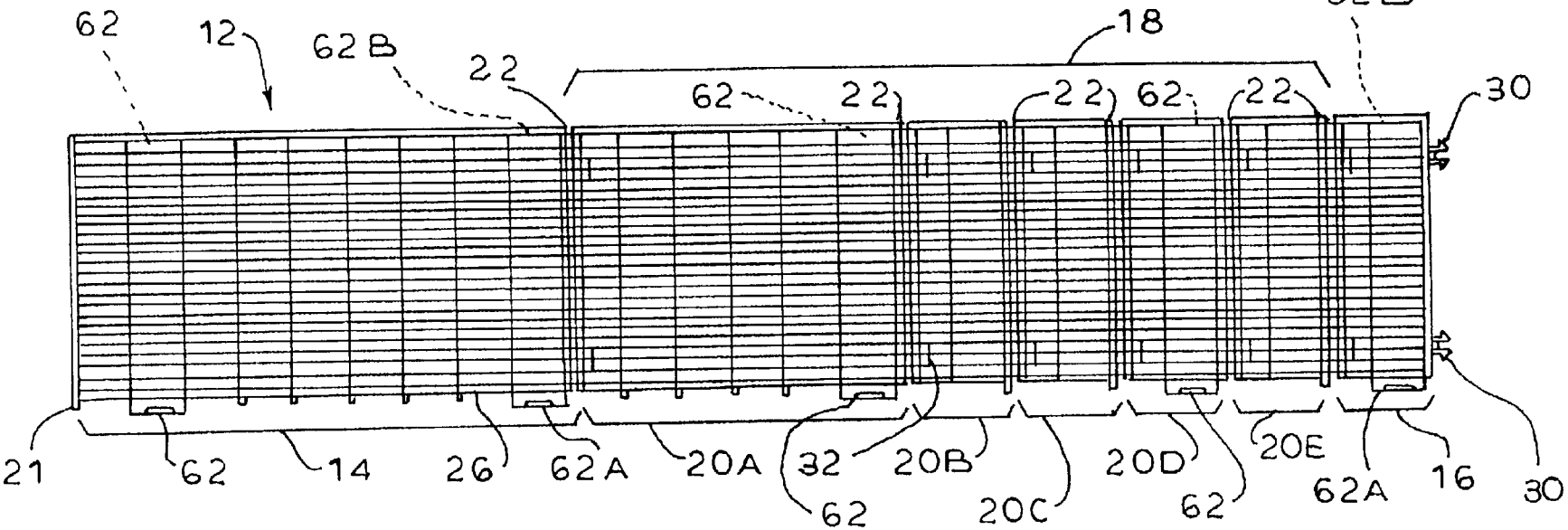
FIG. 4 is a top plan semi-schematic view, to an enlarged scale, of a standard depth display track of the unit.
Figure 5:
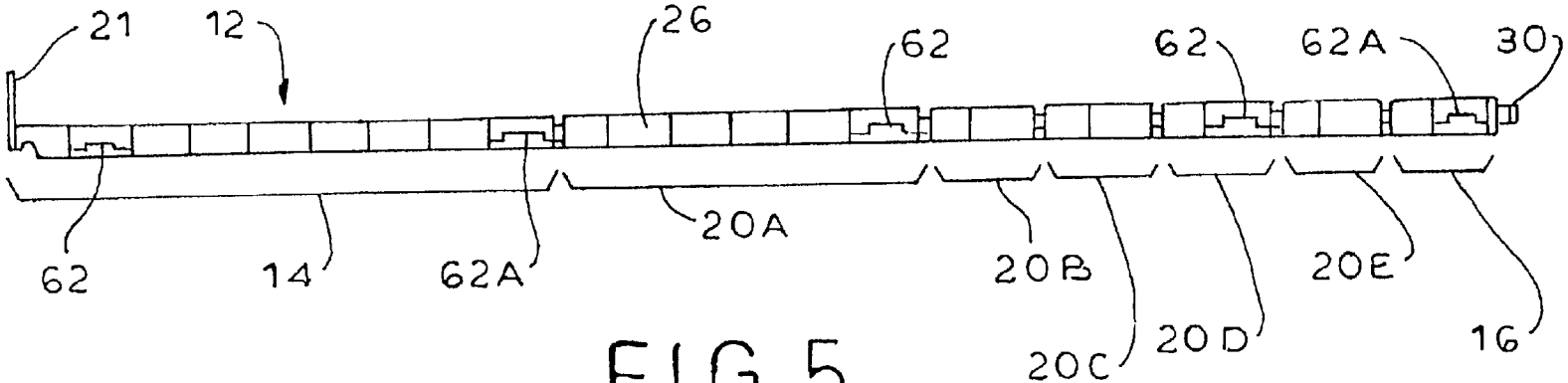
FIG. 5 is a side elevational semi-schematic view, to an enlarged scale, thereof.
Figure 6:
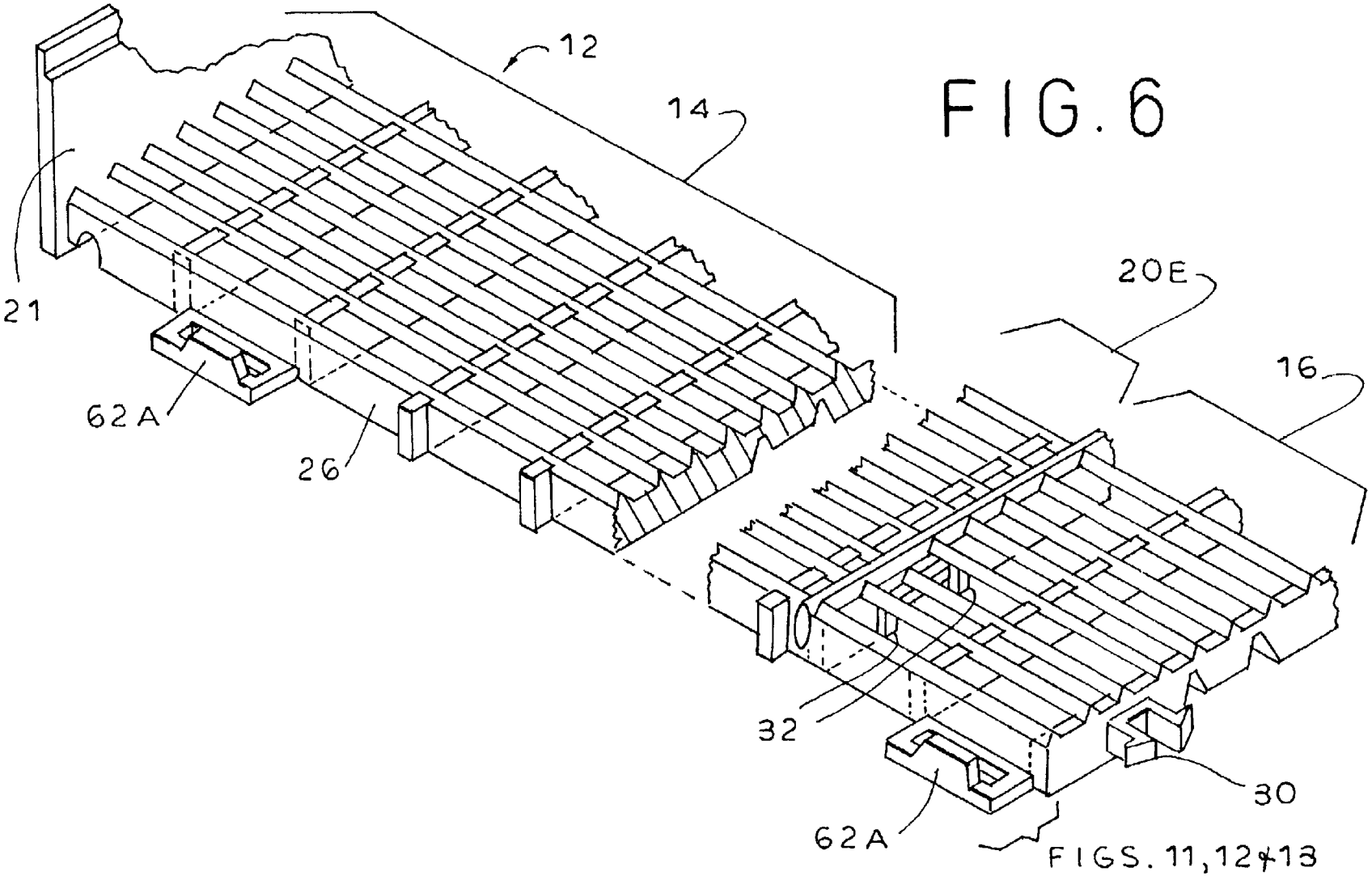
FIG. 6 is a fragmentary isometric view, to a greatly enlarged scale, of a portion of a standard depth display track of the unit.
Figure 7:
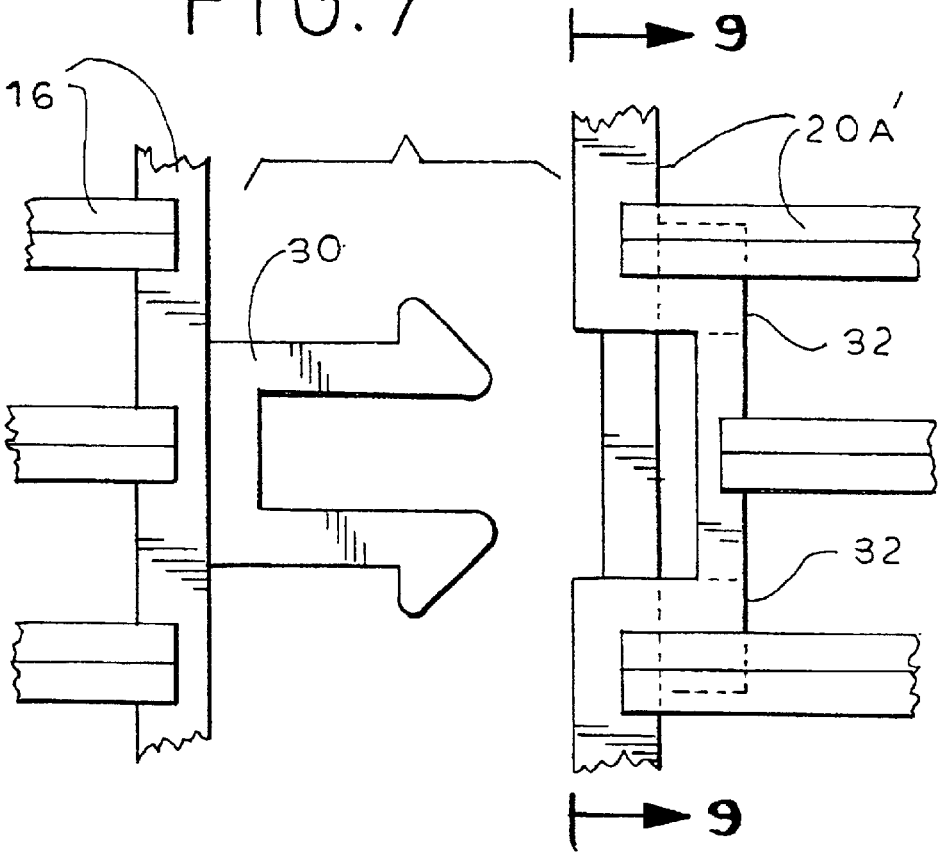
FIGS. 7 and 8 are fragmentary views, to a further enlarged scale, of the bracketed segment of FIG. 3 (identified by the designations of FIGS. 7 and 8) showing the rear and front engagement means in a separated relationship in FIG. 7 and in an engaged relationship in FIG. 8.
Figure 8:
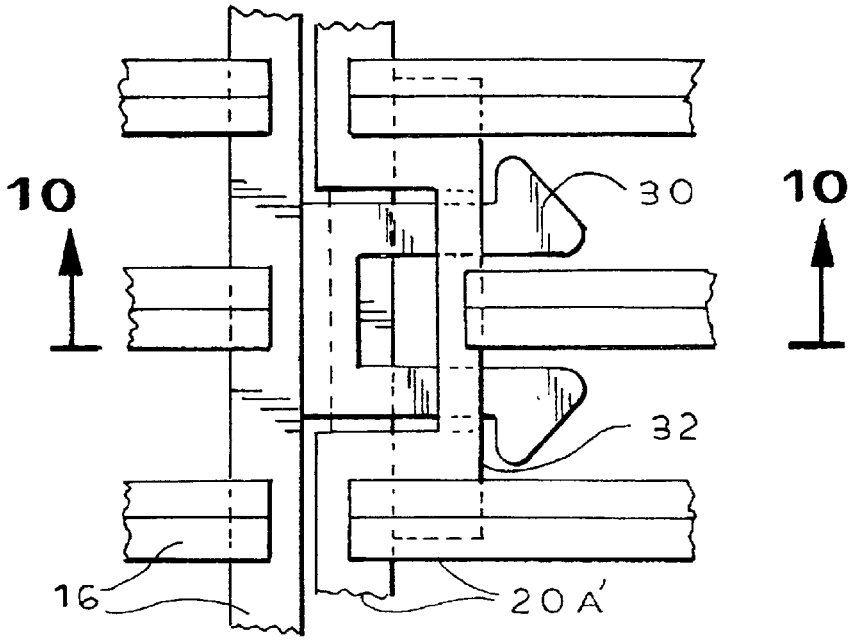
Figure 9:
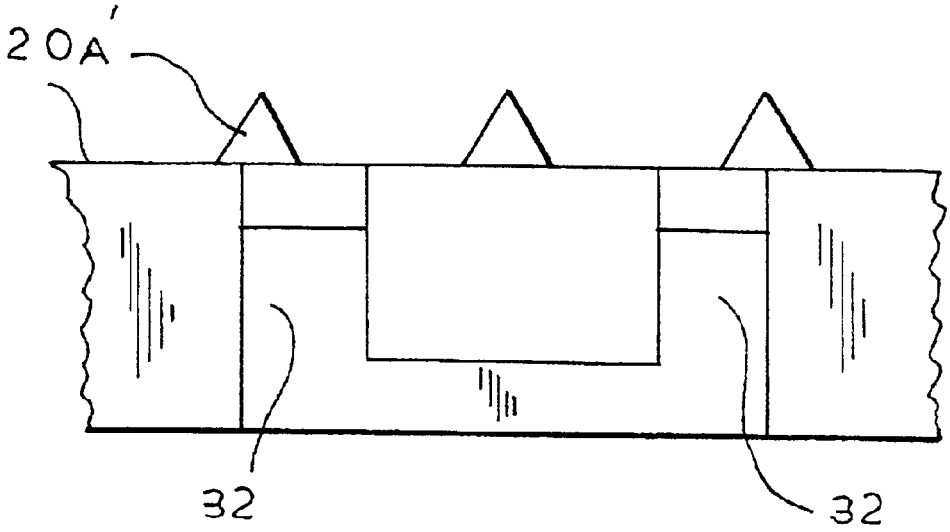
FIGS. 9 and 10 are sectional views taken along the lines 9—9 of FIG. 7 and 10—10 of FIG. 8, respectively.
Figure 10:
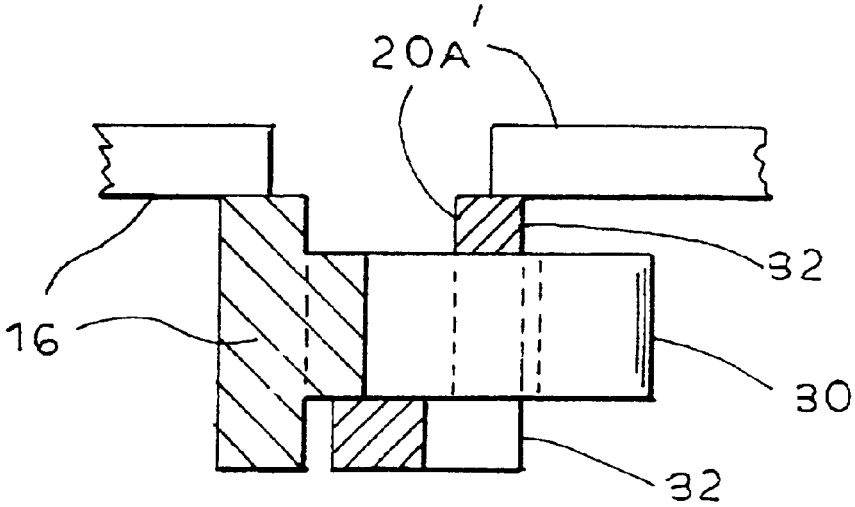

A display tray may consist of a single track 12, just wide enough to accommodate a single lane or channel of product to be displayed, or a plurality of such tracks 12 disposed side-by-side. In the latter instance, each sidewall 26 of a track 12 is provided with lateral connecting means 62 to facilitate joinder of the side-by-side tracks 12, preferably in a releasable manner. Preferably, as illustrated in FIGS. 4–6, the front and back sections 14, 16, the first intermediate section 20A (that is, the intermediate section of greatest length), and at least one or more of the remaining intermediate sections 20B–20E is also provided with connecting means 62. Means for connecting display tracks in side-by-side relationship are well-known in the art and hence, need not be described herein in further detail.

Turning now to the novel aspects of the present invention, and referring now as well to FIGS. 6 through 10, the back section 16 is provided at the rear thereof with rear engagement means 30, and each of the intermediate and back sections 20, 16 defines at the front of each such section 20, 16 forward engagement means 32. The rear engagement means 30 projects rearwardly from the back section 16, and the forward engagement means 32 is disposed at the front of each such section 20,16. Preferably the rear engagement means 30 is male in nature, while the forward engagement means 32 is female in nature, the rear and forward engagement means 30, 32 thus being capable of forming a secure male/female engagement. The forward engagement means 32 is typically configured and dimensioned as a channel with a front constriction designed to receive therethrough and retain therein the two divergently biased barbs of the rear engagement means 30.

Preferably the rear and forward engagement means 30, 32 are both disposed below the level of the article-supporting floor 24 of the intermediate and back sections 20, 16. For example, the forward engagement means 32 may be a channel configured and dimensioned to receive the rear engagement means 30 and extending the full length of the track 12, or just the full length of the back and intermediate sections 16, 20. Alternatively, as illustrated, the forward engagement means 32 need not extend the full length of either intermediate sections 20 or the back section 16 and may simply be disposed at the front of each intermediate section 20 and back section 16. While the rear engagement means 30 always projects rearwardly from the back section 16, available for engagement, the forward engagement means 32 of the back and intermediate sections 16, 20 must be exposed (before engagement by the rear engagement means 30) by breaking away of the immediately forward section thereto (whether that be the front section 16 or an intermediate section 20).

Figure 3:
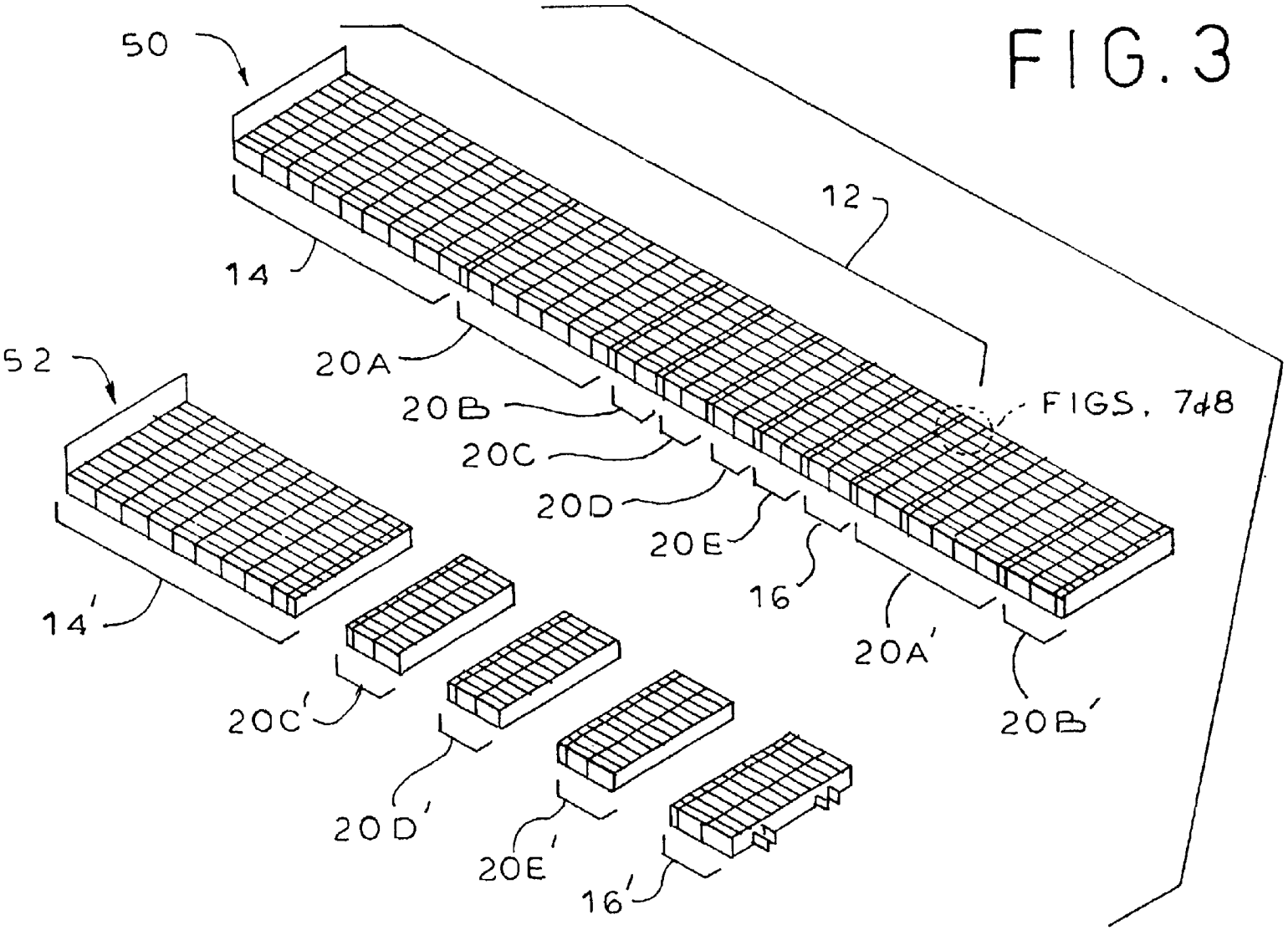
FIG. 3 is an isometric schematic view of a depth-extended display track formed from the unit of FIG. 1 and the left-over remnants of the unit.

Referring now to FIG. 3 in particular, therein illustrated is a depth-extended display track, generally designated 50, formed from a depth-extendable display track unit 10 according to the present invention. Also illustrated therein are the left-over remnants 52 of the second track 12' which has been sacrificed in order to provide the first track 12 with an extension of 8" by donating to the first track 12 two of its intermediate sections 20A' and 20B'. What remains as remnants 52 of the second track 12'—that is, the front section 14', intermediate sections 20C' through 20E'—and back section 16' may be discarded as waste.

Alternatively, the "waste" may be used in the formation of another depth-extended display track (not shown). Where the forward engagement means 32 also extends under the front section 14, the front section 14' of the second track 12' may also be used by itself (rotated 180°) in the formation of another depth-extended display track. Indeed, even where the forward engagement means 32 does not extend under the front section 14, the sub-assembly of the front section 14' and at least one intermediate section 20' left attached thereto may be used (rotated 180°) in the formation of another depth-extended display track.

Preferably, the front section 14 is of the greatest depth (for example, about 9") and the back section 16 is of the least depth (for example, about 2"), while individual ones of the intermediate sections 20 may range from about 2" to 6". The number of intermediate sections 20 in the series 18 may vary, but typically five are provided, initial section 20A being about 6" deep and the remaining sections 20B–20E each being about 2" deep. Thus, between the breakaway back section 16 and the breakaway intermediate sections 20, a standard depth display track 12 of 25" may be reduced to 23" (by removal of a back section 16 of 2" alone), or to 21", 19", 17" or 15" (by further removal of one, two, three or four of the smaller intermediate sections 20 of 2" each) or to 9' (by removal as well of the large intermediate section 20A' of 6").

Thus, a depth-extended display track 50 may be made as deep as 41" and consist of one standard 25" depth track 12 plus one 6" intermediate section 20A' plus four 2" intermediate sections 20B'–20E' plus one 2" back section 16' from the other track 12'. Indeed, it is possible for a depth-extended display track 50 to be made as deep as 48" by including 14" from the intermediate sections 20' and 9" from the front section 14' (rotated 180°).

Further, if the rear engagement means 30 is itself of a breakaway design, a depth-extended display track 50 of 50" may be formed from two standard 25" depth display tracks 12, 12' by simply breaking away the rear engagement means 30' of the second track 12' and then connecting that second track (rotated 180°) to the rear engagement means 30 of the first track 12. Of course, in this instance, there is no waste whatsoever (except for the broken-away rear engagement means 30), but it does require that the forward engagement means 32 either extend the full length of the back section 16 or at least be exposed at the back end thereof after the rear engagement means 30 is removed.

Similarly, if the front lip 21 acting as stop means is itself of a breakaway design, a depth-extend display track 50 of 50" may be formed from two standard 25" depth display tracks 12, 12' by simply breaking away the front lip 21' of the second track 12' and then connecting that second track (without rotation) to the rear engagement means 30 of the first track 12. Of course, in this instance, there is also no waste whatsoever (except for the broken-away front lip 21), but it does require that the forward engagement means 32 either extend the full length of the front section 14 or at least be at the exposed front end thereof after the front lip 21' is removed.

Preferably, as illustrated, at least one of the intermediate sections 20 (e.g., section 20A) differs in depth from at least one other of the intermediate sections 20 to enable fine tuning of the depth of the depth-extended display track 50.

While the sacrifice of one of the tracks 12 to enable the transformation of the other track 12 into the depth-extended track 50 may entail a certain amount of material waste, the economic savings effected by the manufacturer, who is now able to meet the needs of his customers without maintaining at least one independent "add-on section" production line, more that compensates the manufacturer. Further, the present invention places the cost of extending the standard depth display track precisely where it belongs—namely on the retailer who is seeking to maximize the utility of the available shelf-supporting surfaces in his establishment. In other words, the cost is allocated to the person who receives the benefits.

Referring now to FIGS. 4–6 and 11–13 in particular, therein illustrated are the improved lateral connecting means 62 of the present invention, comprising female lateral connecting means 62A and male lateral connecting means 62B. To engage the male and female lateral connecting means 62B, 62A, the male connecting means 62B is forced downwardly into the opening 63 of the female connecting means 62A. During insertion, the male connecting means 62B is cammed along the adjacent inclined surface of the female connecting means 62A until it snaps back underneath the camming surface ledge 64, where it is then held until forcible displacement. For expository purposes and clarity of illustration, lateral connecting means 62 are omitted from FIGS. 1–3.

To summarize, the present invention provides a depth-extendable display track unit enabling a customer to form a depth-extended display track. The unit consists of at least two essentially identical standard depth display tracks and does not require the manufacturer to manufacture, sell or deliver add-on sections to enable formation of the depth-extended display track. Further, the depth-extended display track is achieved without the use of additional components such as fasteners. The unit is simple and inexpensive to manufacture and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the forgoing specification.

I claim:

1. A depth-extendable display track unit comprising at least two essentially identical longitudinally-extending standard depth display tracks for forming a single depth-extended display track from one of said two standard depth display tracks and at least one section of the other of said two standard depth display tracks in longitudinal alignment with said one standard depth display track, each of said essentially identical standard depth display tracks comprising:

(A) a front section;

(B) a breakaway back section with rear engagement means at the rear thereof for clipless engagement with forward engagement means; and (C) an interconnected series of breakaway intermediate sections connecting said front and back sections;

said intermediate and back sections defining at the front of each such section forward engagement means for clipless engagement with said rear engagement means at the rear of said back section of said one standard depth display track for extending the depth of said one standard depth display track, said forward engagement means being exposed for engagement by breaking away of the immediately forward section.

2. The unit of claim 1 wherein, in each of said essentially identical standard depth display tracks, said rear engagement means projects rearwardly from said back section and said forward engagement means is configured and dimensioned to receive therein said rear engagement means.

3. The unit of claim 1 wherein, in each of said essentially identical standard depth display tracks, said front section defines at the front thereof stop means for limiting forward movement of articles on said standard depth display track.

4. The unit of claim 1 wherein, in each of said essentially identical standard depth display tracks, at least one of said intermediate sections differs in depth from at least one other of said intermediate sections.

5. The unit of claim 1 wherein, in each of said essentially identical standard depth display tracks, said forward engagement means is female in nature, said rear engagement means is male in nature, and said forward and rear engagement means cooperatively form a female/male engagement.

6. The unit of claim 1 wherein, in each of said essentially identical standard depth display tracks, said forward and rear engagement means are disposed below the level of an article-supporting surface of said intermediate and back sections.

7. A depth-extendable display track unit comprising at least two essentially identical standard depth display tracks for forming a single depth-extended display track from one of said standard depth display tracks and at least one section of another of said standard depth display tracks in longitudinal alignment with said one standard depth display track, each of said essentially identical standard depth display tracks comprising:

(A) a front section;

(B) a breakaway back section with rear engagement means projecting rearwardly from the rear thereof for clipless engagement with forward engagement means; and (C) an interconnected series of breakaway intermediate sections connecting said front and back sections, at least one of said intermediate sections differing in depth from at least one other of said intermediate sections;

said intermediate and back sections defining at the front of each such section forward engagement means configured and dimensioned to engage said rear engagement means at the rear of said back section of said one standard depth display track for extending the depth of said one standard depth display track, said forward engagement means being exposed for engagement by breaking away of the immediately forward section, said forward and rear engagement means cooperatively forming a female/male engagement.

8. The unit of claim 7 wherein, in each of said essentially identical standard depth display tracks, said forward and rear engagement means are disposed below the level of an article-supporting surface of said intermediate and back sections.

9. A depth-extendable display track unit comprising at least two essentially identical longitudinally-extending standard depth display tracks for forming a single depth-extended display track from one of said two standard depth display tracks and at least one section of the other of said two standard depth display tracks in longitudinal alignment with said one standard depth display track, each of said essentially identical standard depth display tracks comprising:

(A) a front section;

(B) a breakaway back section with rear engagement means at the rear thereof for clipless engagement with forward engagement means; and (C) breakaway section means connecting said front and back sections;

said back section of said other standard depth display track defining at the front thereof forward engagement means for clipless engagement with said rear engagement means at the rear of said back section of said one standard depth display track for extending the depth of said one standard depth display track, said forward engagement means being exposed for engagement by breaking away of said front section.

10. The unit of claim 9 wherein, in each of said essentially identical standard depth display tracks, said rear engagement means projects rearwardly from said back section and said forward engagement means is configured and dimensioned to receive therein said rear engagement means.

11. The unit of claim 9 wherein, in each of said essentially identical standard depth display tracks, said front section defines at the front thereof stop means for limiting forward movement of articles on said standard depth display track.

12. The unit of claim 9 wherein, in each of said essentially identical standard depth display tracks, said back section comprising an interconnected series of breakaway intermediate sections with rear engagement means at the rear of each intermediate section, at least one of said intermediate sections differing in depth from at least one other of said intermediate sections.

13. The unit of claim 9 wherein, in each of said essentially identical standard depth display tracks, said forward engagement means is female in nature, said rear engagement means is male in nature, and said forward and rear engagement means cooperatively form a female/male engagement.

14. The unit of claim 9 wherein, in each of said essentially identical standard depth display tracks, said forward and rear engagement means are disposed below the level of an article-supporting surface of said back section.

15. A depth-extendable display track unit comprising at least two essentially identical longitudinally-extending standard depth display tracks for forming a single depth-extended display track from one of said two standard depth display tracks and at least one section of the other of said two standard depth display tracks in longitudinal alignment with said one standard depth display track, each of said essentially identical standard depth display tracks comprising:

(A) a front section;

(B) a breakaway back section with rear engagement means projecting rearwardly from the rear thereof for clipless engagement with forward engaging means; and (C) breakaway means connecting said front and back sections;

said back section of said other standard depth display track defining at the front thereof forward engagement means configured and dimensioned to engage said rear engagement means at the rear of said back section of said one standard depth display track for extending the depth of said one standard depth display track, said forward engagement means being exposed for engagement by breaking away of said front section, said forward and rear engagement means cooperatively forming a female/male engagement.

16. The unit of claim 15 wherein, in each of said essentially identical standard depth display tracks, said forward and rear engagement means are disposed below the level of an article-supporting surface of said back section.

* * * * *